US005980205A

United States Patent [19]

Sue

[11] Patent Number: 5,980,205

[45] Date of Patent: Nov. 9, 1999

[54] FOLDING FAN

[76] Inventor: Kazuo Sue, 3-10-1-726 Abenosuji, Abeno-ku, Osaka, Japan

[21] Appl. No.: 08/996,300

[22] Filed: Dec. 22, 1997

[30] Foreign Application Priority Data

Dec. 20, 1996 [JP] Japan ..... 8-341303

[51] Int. Cl.[6] ..... A45B 27/00

[52] U.S. Cl. ..... 416/73; 416/70 A; 428/181

[58] Field of Search ..... 416/70 A, 71, 416/72, 73, 142, 143; 428/176, 181

[56] References Cited

U.S. PATENT DOCUMENTS

| | | | |
|---|---|---|---|
| 335,318 | 2/1886 | Silbernik | 416/73 |
| 1,148,520 | 8/1915 | Mann | 416/71 |
| 2,346,596 | 4/1944 | Martin | 416/71 |
| 2,425,789 | 8/1947 | Fisler | 416/73 |
| 4,564,538 | 1/1986 | Scholtz | 416/73 |
| 5,387,084 | 2/1995 | Walberg | 416/70 A |

FOREIGN PATENT DOCUMENTS

| | | | |
|---|---|---|---|
| 455827 | 2/1926 | Germany | 416/73 |

*Primary Examiner*—Christopher Verdier
*Attorney, Agent, or Firm*—Edwin E. Greigg; Ronald E. Greigg

[57] ABSTRACT

A folding fan, more specifically a folding fan used as an advertisement medium. A rectangular shape piece of paper is placed on another paper piece of the same shape, the pieces of paper are opened in such a way that the vertex A at the top right side of one rectangular paper piece is against the center of an opening m selected at a prescribed position on the center line F in the direction of a longer side agrees with the vertex C at the top left side of another rectangular paper piece. The line segment connecting the point E, which is obtained on the vertex side at the bottom right side of the rectangular paper piece at the point where the distance between the vertexes B and D on the bottom side of the two paper pieces opposing the agreed vertex is divided into three equal parts. The agreed vertex A at the top right side of the rectangular paper piece is taken as a bend line, and the rectangular paper piece is folded in the shape of a valley at the bend line. The line segment which is symmetrical to the bend line against the center line F is taken as another bend line, and the rectangular paper piece is folded in a conical shape at another bend line. A plural number of fan-shaped units are continued in such a way that the folded part folded in the shape of a valley of one fan-shaped unit thus formed bites with another folded part folded in a conical shape of another fan-shaped unit. A hole is drilled at the center of the opening of the fan-shaped body, and a folding fan is constituted by binding the fan-shaped units movably around the hole.

5 Claims, 6 Drawing Sheets

FOLDING FAN

FIELD OF INVENTION

The present invention relates to a folding fan, more specifically to a folding fan usable as an advertisement medium.

BACKGROUND OF THE INVENTION

FIG. 6 and FIG. 7 are plan views showing the construction of a conventional paper folding fan.

As shown in FIG. 6 and FIG. 7, a plural number of fan-shaped paper pieces 21, in which one side of the paper piece 20 is folded in the shape of a valley at a bend line 22 and the other side of the paper piece 20 is folded in a conical shape at a bend line 23, are placed one upon another, and are connected to one another by a grommet at one end in a mutually movable way. Here, the respective fan-shaped paper pieces 21 are placed one upon another in such a way that the part folded in the shape of a valley 24 of the fan-shaped paper piece on the under side bites with the part folded in a conical shape 25 of the fan-shaped paper piece on the upper side.

If you open this paper folding fan to the left and right by holding it at the fan-shaped paper piece 21 at the top and bottom ends of the fan, the part folded in the shape of a valley 24 of the fan-shaped paper piece on the under side and the part folded in a conical shape 25 of the fan-shaped paper piece on the upper side bite with each other, and the top of the fan-shaped paper pieces 21 are displaced sideward one after another to open the paper folding fan. If the folding fan is designed in a way to show an advertisement of some specific enterprise in such an open state, and used by spectators at a sports stadium, etc., it serves as an advertisement medium. Moreover, even in the case without printing of an advertisement, the folding fan has the function of an ordinary folding fan.

The bend line of the fan-shaped paper pieces of the conventional paper folding fan of this type was not determined by any specific rule but was decided arbitrarily by the manufacturing worker. For that reason, it was often the case that, when the paper fan is opened, a deviation of biting is produced at the intermediate part as shown in FIG. 9 if the tip of the fan-shaped paper pieces is made to bite accurately as shown in FIG. 8. Moreover, depending on the position of the bend line, a deviation of biting *produced at the tip of the paper pieces are made to bite accurately at the intermediate part conversely. On the other hand, if you try to fit the biting of the folded parts accurately, it produces a deviation of the center position, thus causing a loss of function of the folding fan. The conventional type of folding fan did not sufficiently discharge the function of a folding fan of a single-sheet shape because of poor fitting at the folded part as described above, making the fan-shaped paper float up when the paper folding fan is opened, and also because of poor strength due to insufficient biting.

Although it is possible to form fan-shaped paper pieces capable of compensating for said defects comparatively easily if the paper piece 20 before folding is formed in a fan shape, an extra work of cutting the material paper into a fan shape is required in this case, thus producing a defect of increasing the working processes. On the other hand, if you use fan-shaped paper pieces made from paper pieces of a rectangular shape 20, it makes said defect appear conspicuously although the number of processes decreases.

The object of the present invention, proposed in view of said circumstance, is to provide a folding fan capable of ensuring an accurate fitting of the folded parts and having a sufficient strength as a folding fan of a single-sheet shape.

SUMMARY OF THE INVENTION

The present invention adopts the following means to achieve said object: firstly, in the state where a paper piece 1*b* of rectangular shape is used to generically designate a rectangular paper piece is placed on another paper piece 1*a* of the same shape, the folding fan is opened in such a way that the vertex A at the top right side of the rectangular paper piece 1*a* on one hand against the center of opening m selected at a prescribed position on the center line F in the direction of a longer side agrees with the vertex at the top left side of the other rectangular paper piece 1*b*. In this state, the point E is obtained on the vertex side at the bottom right side of said rectangular paper piece 1*a* on the one hand of the points where the distance between the vertexes B and D on the bottom side of the two paper pieces opposing said agreed vertex is divided into 3 equal parts. The line segment connecting this point E with said agreed vertex A at the top right side of said rectangular paper piece 1*a* on one hand is taken as a bend line 3, and said rectangular paper piece 1*a* on one hand is folded in the shape of a valley at bend line 3. Next, the line segment which is symmetrical to said bend line 3 against the center line F is taken as bend line 4, and said rectangular paper piece 1*a* on one hand is folded in conical shape at bend line 4.

Thus a fan-shaped unit 30 is formed.

And, a fan-shaped body 300 is formed by continuing a plurality of fan-shaped units 30 in such a way that the folded part 5 folded in the shape of a valley of one fan-shaped unit 30 bites with the folded part 6 folded in a conical shape of the fan-shaped unit 30 formed by another rectangular paper piece 1. Next, a hole 7 is drilled at the center of opening of the fan-shaped body 300, and a folding fan is constituted by binding the fan-shaped units 30 movably around said hole 7.

Moreover, in said construction, it is possible to prevent the folded part from appearing in the surface by disposing the fan-shaped unit 30*a* folded in a conical shape at said two bend lines at the top end and the fan-shaped unit 30*b* folded in the shape of a valley at said two bend lines at the bottom end.

When folding said rectangular paper piece 1*b* at said bend lines 3, 4 it is very difficult to fold it accurately at the vertex. This folding becomes easier by cutting the tip of the rectangular paper piece 1*b*. Moreover, it is also possible to make the lapping accurately and facilitate the turning by cutting, as required, the bottom corners 8, 9 of folded parts 5, 6 which come in the way by making contact with other fan-shaped units at the time of lapping or turning.

EMBODIMENT OF THE INVENTION

Figure 1:
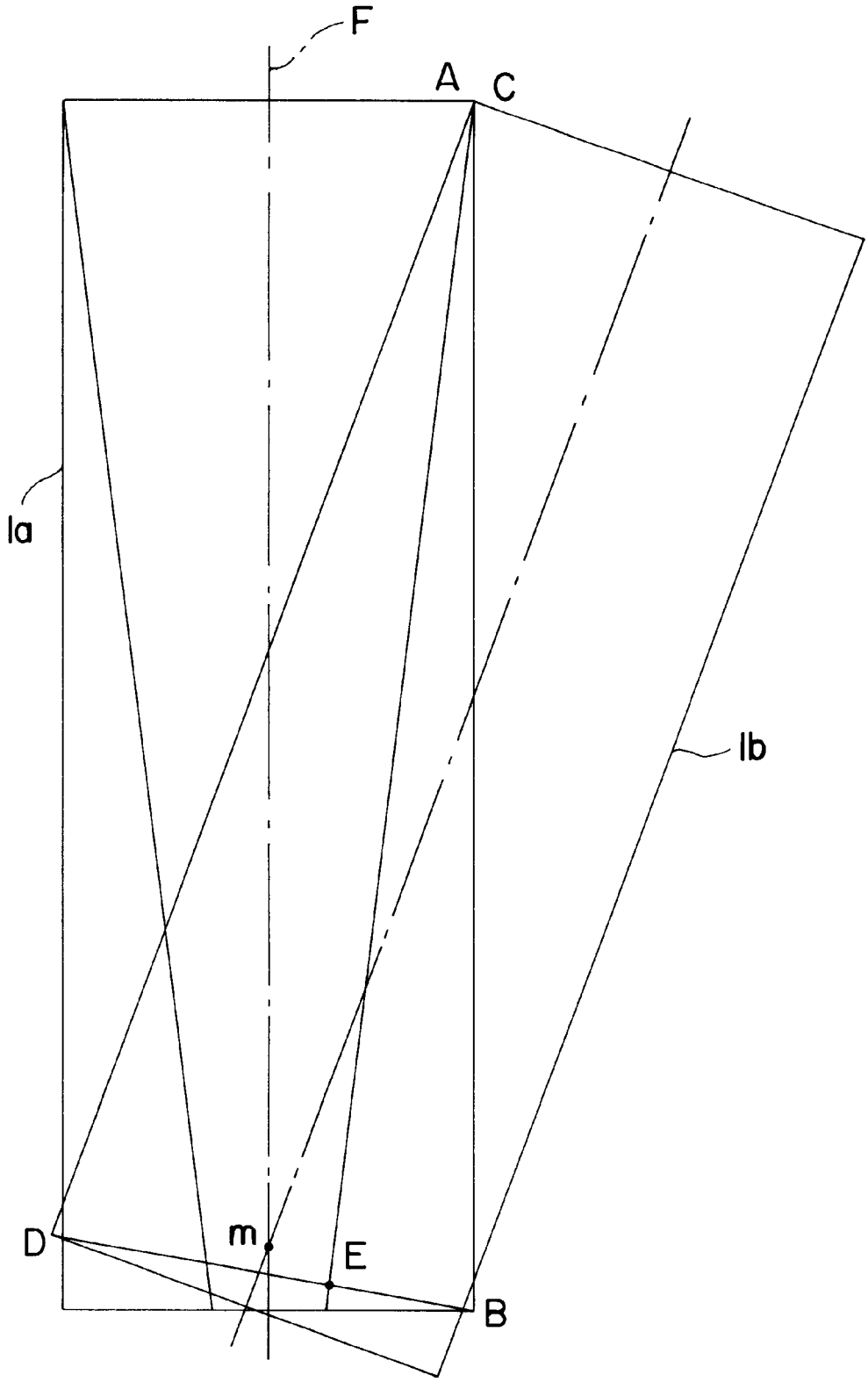
FIG. 1 is an explanatory drawing of bend lines of an embodiment of the present invention.
Figure 2:
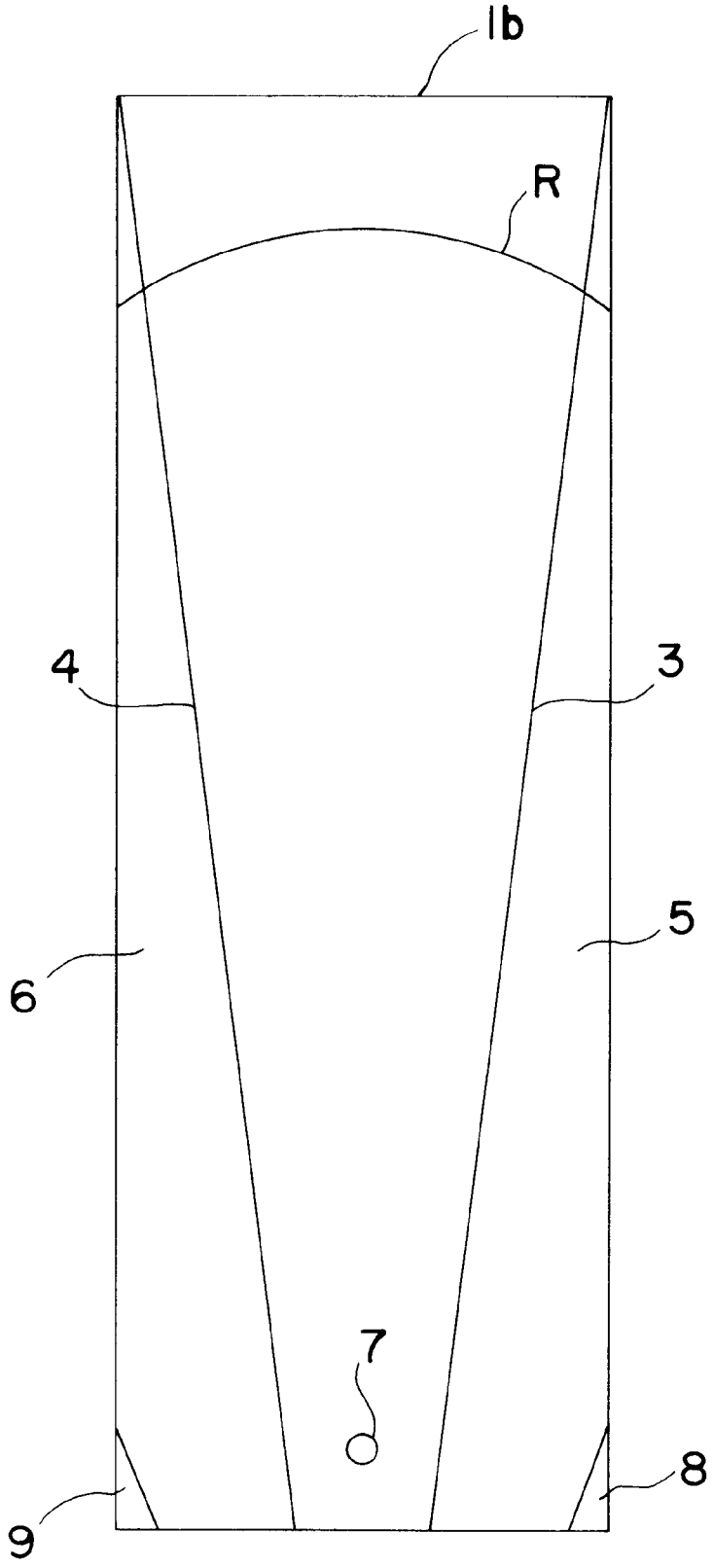
FIG. 2 is an exploded view of the rectangular paper piece of an embodiment of the present invention.
Figure 3:
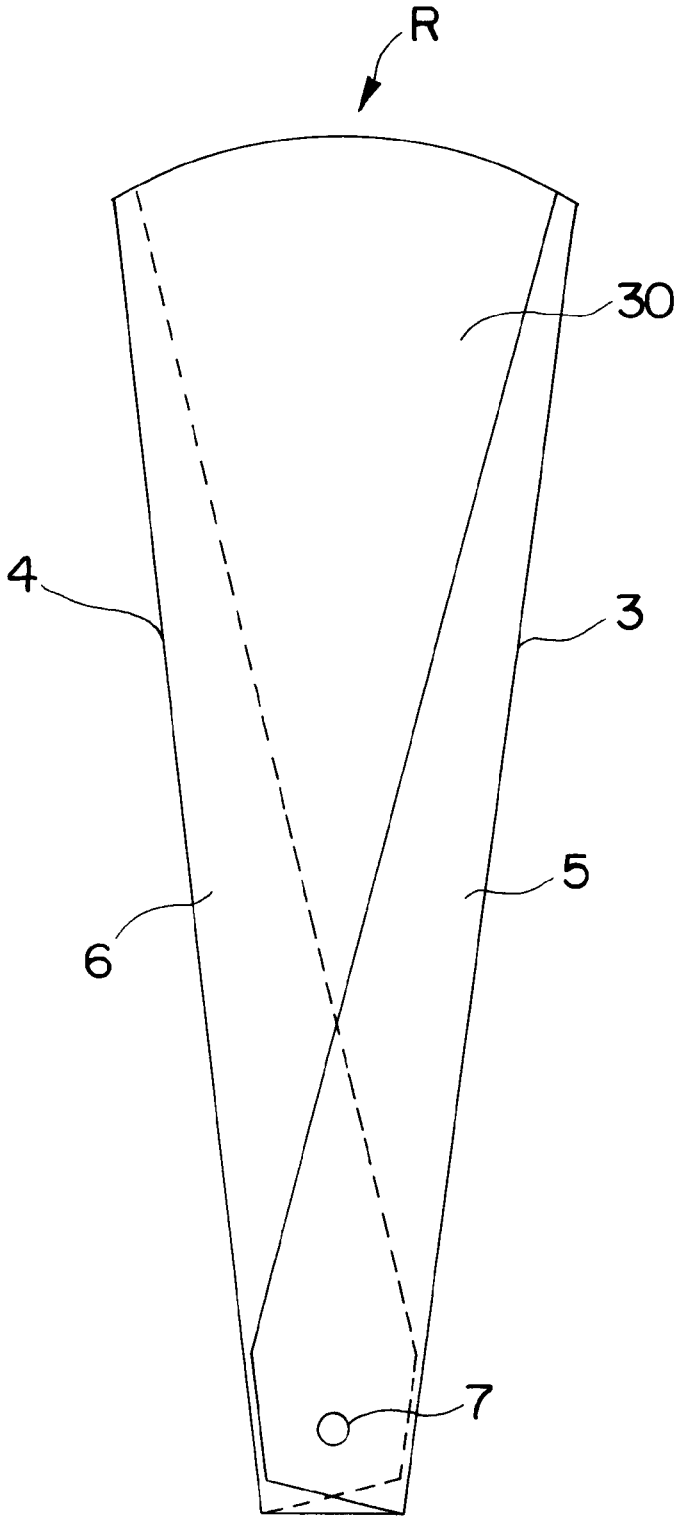
FIG. 3 is the front elevation of a folded fan-shaped unit of an embodiment of the present invention.

An embodiment of the folding fan according to the present invention will be described hereafter based on FIGS. 1 to 3.

In the state where the center of opening m is selected at a prescribed position on the center line F in the direction of a longer side of one rectangular paper piece 1*a* and that another paper piece 1*b* of the same shape is placed on the rectangular paper piece 1*a*, the folding fan is opened in such a way that the vertex A at the top right side of one rectangular paper piece 1*a* agrees with the vertex C at the top left side of another rectangular paper piece 1*b* by said center of opening m. The line segment B-D connecting between the vertex B at the bottom right side opposing said vertex A of the rectangular paper piece 1*a* on one side and the vertex D at bottom left side of the rectangular paper piece 1*a* on the other side is divided into three equal parts, and the point E of a division into three equal parts on the vertex B side is determined. Next, the line segment connecting said point E of the division into three equal parts with said vertex A is taken as a bend line 3, and said rectangular paper piece 1*a* on the one hand is folded in the shape of a valley there. The line segment which is symmetrical to said bend line 3 against said center line F is taken as a bend line 4, and said rectangular paper piece 1*a* on the one hand is folded in conical shape there.

A plural number of fan-shaped units 30, which are folded in the shape of a valley and in a conical shape at the bend lines 3, 4 as described above, are continued in such a way that the folded part 5 folded in the shape of a valley of the fan-shaped unit on the under side bites with the folded part 6 folded in conical shape of the fan-shaped unit on the upper side. Here, a fan-shaped unit 30*a* folded in a conical shape at said two bend lines 3,4 is disposed at the top end and a fan-shaped unit 30*b* folded in the shape of a valley at said two bend lines is disposed at the bottom end, and they are continued in the same way as above.

A hole 7 is drilled at said center of opening m of a plural number of fan-shaped units 30 placed one upon another as described above, a grommet 10 is passed through the hole 7, and a folding fan is constituted by rotatably binding the fan-shaped units 30. Since it is very difficult to fold said rectangular paper piece 1*b* at said bend lines 3, 4 accurately at the vertex, it is desirable to cut the tip of the rectangular paper piece 1*b* and, in the embodiment, the tip of the rectangular paper piece 1*b* is cut in the shape of an arc R so that the bend lines 3, 4 do not agree with the upper corner of the rectangular paper piece 1*b*. Moreover, to prevent the folded parts 5, 6 from coming in the way by making contact with other fan-shaped units at the time of lapping or turning, the lower corners 8, 9 are cut as required.

Figure 4:
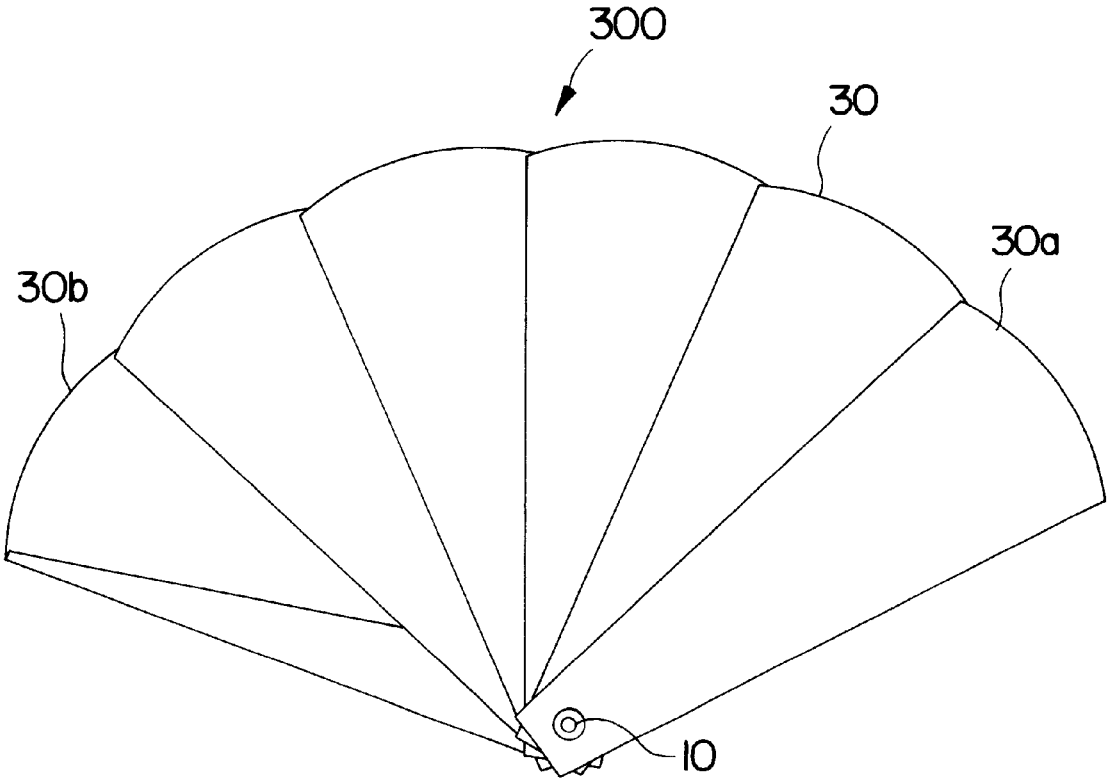
FIG. 4 is the front elevation of an embodiment of the present invention.
Figure 5:
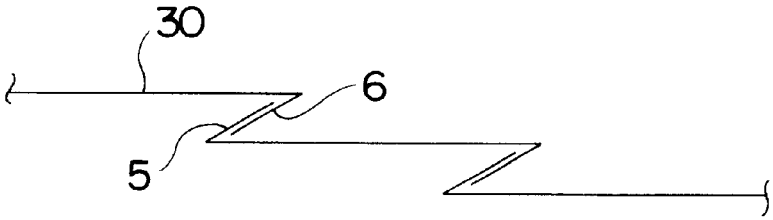
FIG. 5 is the top view of an embodiment of the present invention.
Figure 6:
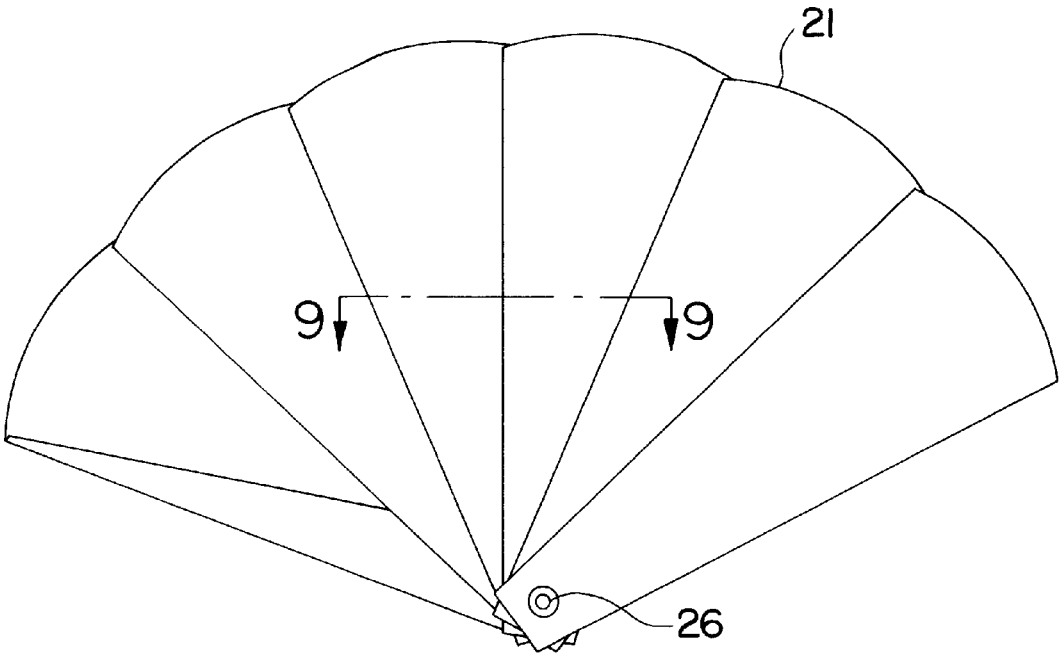
FIG. 6 PRIOR ART
FIG. 6 is the front elevation of a conventional example.
Figure 7:
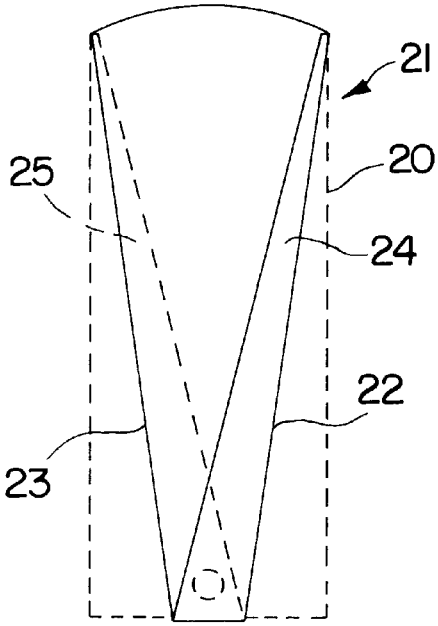
FIG. 7 PRIOR ART
FIG. 7 is the front elevation of a folded fan-shaped paper piece of a conventional example.
Figure 8:
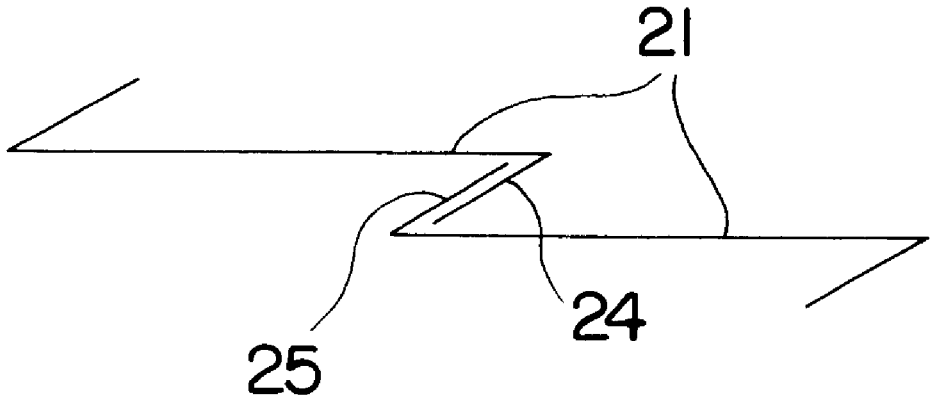
FIG. 8 PRIOR ART
FIG. 8 is the top view of a conventional example.
Figure 9:
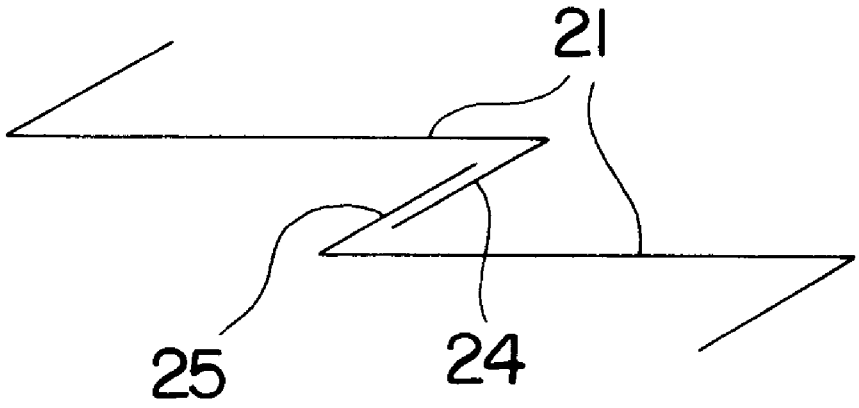
FIG. 9 PRIOR ART
FIG. 9 is a sectional view X–X' on FIG. 6 of a conventional example.

If you open this paper folding fan to the left and right by holding it at the fan-shaped units 30*a*, 30*b* at the top and bottom ends of the fan, the part folded in the shape of a valley 5 of the fan-shaped unit 30 on the under side and the part folded in conical shape 6 of the fan-shaped unit 30 in the upper side bite with each other, and the tip of the fan-shaped units 30 is displaced sideward one after another to open the folding fan as shown in FIG. 4. In this state, the part folded in the shape of a valley 5 and the part folded in conical shape 6 of the respective fan-shaped units 30 bite with each other on almost the entire surface, and the fan-shaped advertisement medium is opened in the shape of a single sheet. If the folding fan is designed in a way to show an advertisement image (including characters) in such an open state, it can be used as an advertisement medium and can also be utilized as a fancy paper or picture card, etc.

Moreover, to fold this folding fan, all you have to do is to fold it in the direction in which the respective fan-shaped units 30 come to lap one another from said open state.

Said rectangular paper piece 1 may be made not simply with paper but also with cloth or synthetic resin, etc. with no particular restriction about the material.

As it has been described so far, the present invention makes it possible to decide the bend lines easily regardless of the size and shape of the rectangular paper piece and, therefore form a folding fan with sufficient strength as a folding fan in the shape of a single sheet. It also enables effective utilization of the material because the fan-shaped units are obtained from rectangular paper pieces.

What is claimed is:

1. A fan-shaped folding fan which comprises:

a first and a second rectangular sheet of paper (1*a*, 1*b*) both having the same size, said second rectangular sheet of paper (1*b*) is placed over said first rectangular sheet of paper so that a left vertex (C) of said second sheet of paper overlies a right vertex (A) of said first sheet of paper, with the right vertex (A) and the left vertex (C) positioned together, a hole (M) is formed at an intersection of a center line of each of said first and second sheets of paper, a line is extended from a bottom vertex (B) of the first sheet of paper to a bottom vertex (D) of said second sheet of paper, the line (B-D) is divided into three equal segments and a first fold line (3) is extended from said right vertex (A) to one of said equal segments (E) to a right of the hole (M) and a second fold line (4) is extended from a left upper vertex of the first sheet of paper to one of said equal segments to a left of the hole (M), a part (5) of the second sheet of paper (1*b*) is folded along the first fold line (3) upwardly and back along a surface of the first sheet of paper to form a valley, and a part (6) of the first sheet of paper is folded along the second fold line (4) downwardly and along a lower surface of the first sheet to form a second valley, and opposite corners of said first sheet are cut angled toward the bottom thereof and toward the center of said first sheet.

2. A fan-shaped folding fan as set forth in claim 1, in which a portion of an upper portion of said first sheet of paper is cut in the form of an arc (R).

3. A fan-shaped folding fan as set forth in claim 1, in which a plurality of fan shaped units are formed, and each fan shaped unit is placed over each other in order and secured together on their center lines for rotation about a pivot means in said hole (M).

4. A fan-shaped folding fan as set forth in claim 3, in which a portion of an upper portion of said first sheet of paper is cut in the form of an arc (R).

5. A fan-shaped folding fan as set forth in claim 3, in which each of the fan units are rotated about the pivot means such that the valley formed by part (6) of one fan unit will engage the valley formed by part (5) of an adjacent fan unit until each unit has been rotated about the pivot means.

* * * * *